US009322401B2

(12) United States Patent
Hahn et al.

(10) Patent No.: US 9,322,401 B2
(45) Date of Patent: Apr. 26, 2016

(54) LINEAR COMPRESSOR

(71) Applicant: General Electric Company, Schenectady, NY (US)

(72) Inventors: Gregory William Hahn, Mount Washington, KY (US); Thomas R. Barito, Louisville, KY (US)

(73) Assignee: General Electric Company, Schenectady, NY (US)

( * ) Notice: Subject to any disclaimer, the term of this patent is extended or adjusted under 35 U.S.C. 154(b) by 284 days.

(21) Appl. No.: 14/176,982

(22) Filed: Feb. 10, 2014

(65) Prior Publication Data

US 2015/0226203 A1 Aug. 13, 2015

(51) Int. Cl.

| | |
|---|---|
| ***F04B 35/04*** | (2006.01) |
| ***F04B 39/00*** | (2006.01) |
| ***F04B 39/12*** | (2006.01) |

(52) U.S. Cl.

CPC ..... *F04B 35/045* (2013.01); *F04B 39/0005* (2013.01); *F04B 39/122* (2013.01)

(58) Field of Classification Search

CPC .. F04B 39/0005; F04B 39/122; F04B 35/045; F04B 39/0223; F04B 39/0276; F04B 39/0284; F04B 39/0292; F01B 31/10; F16J 10/04

USPC ..... 417/415, 416, 417

See application file for complete search history.

(56) References Cited

U.S. PATENT DOCUMENTS 1,693,114 A * 11/1928 Heany ..... F02M 37/08 137/533.17
2,865,559 A * 12/1958 Gigler ..... F04B 35/045 417/363
3,153,990 A * 10/1964 Kunzog ..... B22F 7/002 138/143
3,481,316 A * 12/1969 Olson ..... F02F 1/14 123/193.1
3,542,495 A * 11/1970 Barthalon ..... H02K 33/02 310/24
4,067,667 A * 1/1978 White ..... F04B 35/045 417/416
4,875,840 A * 10/1989 Johnson ..... F04C 29/023 184/6.18
4,996,908 A * 3/1991 Thompson ..... B23B 31/302 277/549
5,146,124 A * 9/1992 Higham ..... F16F 7/116 310/17
5,525,845 A * 6/1996 Beale ..... F02G 1/0435 310/12.27
5,597,294 A * 1/1997 McGrath ..... F04B 35/04 417/417
5,749,331 A * 5/1998 Pettersson ..... C22C 33/0207 123/193.2
5,944,302 A * 8/1999 Loc ..... F04B 35/045 267/180
5,993,178 A * 11/1999 Park ..... F04B 35/045 417/416

(Continued)

FOREIGN PATENT DOCUMENTS

BR WO 2013026115 A1 * 2/2013 ..... F04B 35/045
EP 0620367 4/1993

(Continued)

*Primary Examiner* — Bryan Lettman
*Assistant Examiner* — David Brandt
(74) *Attorney, Agent, or Firm* — Dority & Manning, P.A.

(57) ABSTRACT

A linear compressor and a method for lubricating a piston in the same are provided. The linear compressor includes a sleeve that defines a groove, a plurality of channels and a plurality of thru-holes. A piston is slidably received within a chamber of the sleeve. The piston defines a plurality of pockets. The groove of the sleeve, the plurality of channels of the sleeve, the plurality of thru-holes of the sleeve, and the plurality of pockets of the piston are configured for directing liquid oil therethrough during operation of the linear compressor.

18 Claims, 8 Drawing Sheets

(56) References Cited

U.S. PATENT DOCUMENTS 6,085,530 A * 7/2000 Barito ..... F04C 28/28 361/22
6,092,999 A * 7/2000 Lilie ..... F04B 35/045 417/415
6,398,523 B1 * 6/2002 Hur ..... F04B 39/0055 417/312
6,491,506 B1 * 12/2002 Oh ..... F04B 35/045 417/406
6,812,597 B2 * 11/2004 McGill ..... F04B 35/045 310/12.19
6,946,754 B2 * 9/2005 Inagaki ..... H02K 33/16 310/12.25
7,249,938 B2 * 7/2007 Noh ..... F04B 35/045 128/204.18
7,566,206 B2 * 7/2009 Lee ..... F04B 25/005 417/258
7,614,856 B2 * 11/2009 Inagaki ..... F04B 35/045 267/136
7,618,243 B2 * 11/2009 Tian ..... F04B 35/045 417/417
7,692,339 B2 * 4/2010 Berchowitz ..... F01B 11/007 310/12.01
7,921,845 B2 * 4/2011 Kim ..... F04B 35/045 128/204.18
7,988,430 B2 * 8/2011 Kang ..... F04B 35/045 417/416
8,011,183 B2 9/2011 Berchowitz
8,033,795 B2 * 10/2011 Dainez ..... F04B 35/045 318/687
8,070,460 B2 * 12/2011 Lee ..... F04B 39/0261 417/211
8,127,560 B2 * 3/2012 Dicken ..... F16F 1/125 60/520
8,177,523 B2 * 5/2012 Patel ..... F04B 35/045 29/596
8,241,015 B2 * 8/2012 Lillie ..... F04B 35/045 417/363
8,850,845 B1 * 10/2014 Tucker ..... F04B 17/04 417/415
8,876,497 B2 * 11/2014 Kim ..... F04B 39/121 417/363
8,894,380 B2 * 11/2014 Kang ..... F04B 17/04 417/417
8,944,785 B2 * 2/2015 Lilie ..... F04B 35/045 417/417
8,998,589 B2 * 4/2015 Lilie ..... F04B 35/045 417/410.1
2004/0001768 A1 * 1/2004 Fujisawa ..... F04B 35/045 417/416
2004/0052658 A1 * 3/2004 Lilie ..... F04B 35/045 417/363
2004/0258543 A1 * 12/2004 Kim ..... H02K 1/146 417/417
2005/0008512 A1 * 1/2005 McGill ..... F04B 35/045 417/416
2005/0123422 A1 * 6/2005 Lilie ..... F04B 35/045 417/416
2005/0163635 A1 * 7/2005 Berwanger ..... F04B 35/045 417/415
2005/0281691 A1 * 12/2005 Lee ..... F04B 39/066 417/417
2006/0051220 A1 * 3/2006 Kwon ..... F04B 39/0276 417/416
2006/0093495 A1 * 5/2006 Oh ..... F04B 35/045 417/417
2006/0093496 A1 * 5/2006 Lee ..... F04B 35/045 417/417
2006/0120891 A1 * 6/2006 Jung ..... F04B 35/045 417/366
2006/0171822 A1 * 8/2006 Seagar ..... F04B 35/045 417/410.1
2007/0039157 A1 * 2/2007 Rateick, Jr. ..... F04B 1/2035 29/434
2007/0040456 A1 * 2/2007 Hansen ..... F04B 35/045 310/14
2007/0041853 A1 * 2/2007 Hansen ..... F04B 39/0292 417/417
2007/0041854 A1 * 2/2007 Hansen ..... F04B 35/045 417/417
2007/0041855 A1 * 2/2007 Hansen ..... F04B 35/045 417/417
2007/0041856 A1 * 2/2007 Hansen ..... F04B 49/14 417/417
2007/0110600 A1 * 5/2007 Park ..... F04B 35/045 417/417
2007/0134108 A1 * 6/2007 Her ..... F04B 35/045 417/417
2007/0159128 A1 * 7/2007 Dainez ..... F04B 35/045 318/687
2007/0286751 A1 * 12/2007 Manole ..... F04B 35/045 417/417
2007/0295201 A1 * 12/2007 Dadd ..... F04B 35/045 92/10
2008/0019853 A1 * 1/2008 Hashida ..... F02M 59/102 417/490
2008/0240950 A1 * 10/2008 McGill ..... F04B 35/045 417/437
2008/0314581 A1 * 12/2008 Brown ..... E21B 43/127 166/105
2009/0039655 A1 * 2/2009 Berchowitz ..... F02G 1/043 290/1 A
2009/0094977 A1 * 4/2009 Hill ..... F02G 1/053 60/520
2009/0116983 A1 * 5/2009 Jeong ..... F04B 35/045 417/416
2009/0238701 A1 * 9/2009 Giacchi ..... F04B 39/16 417/321
2009/0252623 A1 * 10/2009 Choi ..... H02K 33/02 417/416
2009/0263262 A1 * 10/2009 McGill ..... F04B 35/045 417/415
2009/0280015 A1 * 11/2009 Lillie ..... F04B 35/045 417/416
2009/0297363 A1 * 12/2009 Killion ..... F04C 2/102 417/46
2010/0183450 A1 * 7/2010 Schmidt ..... F04B 35/045 417/212
2010/0202896 A1 * 8/2010 Du ..... F04D 29/106 417/53
2010/0260627 A1 * 10/2010 Kang ..... F04B 35/045 417/417
2010/0260628 A1 * 10/2010 Kim ..... F04B 39/121 417/417
2010/0266429 A1 * 10/2010 Kang ..... F04B 39/0088 417/417
2010/0288222 A1 * 11/2010 Urabe ..... F16J 10/04 123/193.2
2010/0296951 A1 * 11/2010 Lee ..... F04B 35/045 417/417
2010/0310394 A1 * 12/2010 Giacchi ..... F04B 35/045 417/417
2011/0056196 A1 * 3/2011 Berchowitz ..... F02G 1/0435 60/517
2011/0058960 A1 * 3/2011 Bernhard Lilie ..... F04B 35/045 417/63
2011/0097224 A1 * 4/2011 Kang ..... F04B 35/045 417/417
2011/0135518 A1 * 6/2011 Kang ..... F04B 35/045 417/417
2011/0236236 A1 * 9/2011 Larsen ..... F04B 43/04 417/416
2012/0034114 A1 * 2/2012 Lee ..... F04B 35/045 417/417
2012/0100020 A1 * 4/2012 Park ..... F04B 39/023 417/410.1
2012/0107144 A1 * 5/2012 Keifer ..... F04B 27/0404 417/53
2012/0177513 A1 * 7/2012 Lilie ..... F04B 35/045 417/417
2012/0251359 A1 * 10/2012 Neelakantan ..... F04B 17/046 417/416
2013/0058799 A1 * 3/2013 Scarpinato ..... F04B 49/06 417/53

(56) References Cited

U.S. PATENT DOCUMENTS

2014/0072461 A1* 3/2014 Barito ..... F04B 35/045 417/415
2014/0072462 A1* 3/2014 Filippa ..... F04B 35/045 417/415
2014/0127058 A1* 5/2014 Buckley ..... F04B 39/10 417/415
2014/0241919 A1* 8/2014 Jeong ..... F04B 35/045 417/416
2014/0311337 A1* 10/2014 Muhle ..... F04B 39/122 92/169.1
2014/0318365 A1* 10/2014 Muhle ..... F04B 35/045 92/153
2015/0004025 A1* 1/2015 Kang ..... F04B 49/225 417/415
2015/0219038 A1* 8/2015 Jose Da Rocha Mordente ..... F02F 1/004 428/544
2015/0219095 A1* 8/2015 Muhle ..... F04B 39/0292 92/169.1
2015/0226194 A1* 8/2015 Barito ..... F04B 39/0005 417/417
2015/0226196 A1* 8/2015 Barito ..... F04B 35/045 417/363
2015/0226197 A1* 8/2015 Hahn ..... F04B 35/045 417/363
2015/0226198 A1* 8/2015 Hahn ..... F04B 35/045 417/53
2015/0226199 A1* 8/2015 Barito ..... F04B 35/04 417/363
2015/0226200 A1* 8/2015 Beers ..... F04B 39/0005 417/416
2015/0226202 A1* 8/2015 Beers ..... F04B 39/0005 417/363
2015/0226203 A1* 8/2015 Hahn ..... F04B 35/045 417/415
2015/0226210 A1* 8/2015 Barito ..... F04B 35/045 417/415
2015/0285235 A1* 10/2015 Ahn ..... F04B 39/0005 417/416
2016/0006331 A1* 1/2016 Hong ..... H02K 33/00 417/416
2016/0017873 A1* 1/2016 Byun ..... F04B 35/045 417/416

FOREIGN PATENT DOCUMENTS

WO WO 2005/028841 3/2005
WO WO 2006/013377 2/2006
WO WO 2006/081642 2/2006
WO WO 2013/003923 1/2013

* cited by examiner

LINEAR COMPRESSOR

FIELD OF THE INVENTION

The present subject matter relates generally to linear compressors, e.g., for refrigerator appliances.

BACKGROUND OF THE INVENTION

Certain refrigerator appliances include sealed systems for cooling chilled chambers of the refrigerator appliance. The sealed systems generally include a compressor that generates compressed refrigerant during operation of the sealed system. The compressed refrigerant flows to an evaporator where heat exchange between the chilled chambers and the refrigerant cools the chilled chambers and food items located therein.

Recently, certain refrigerator appliances have included linear compressors for compressing refrigerant. Linear compressors generally include a piston and a driving coil. The driving coil receives a current that generates a force for sliding the piston forward and backward within a chamber. During motion of the piston within the chamber, the piston compresses refrigerant. However, friction between the piston and a wall of the chamber can negatively affect operation of the linear compressors if the piston is not suitably aligned within the chamber. In particular, friction losses due to rubbing of the piston against the wall of the chamber can negatively affect an efficiency of an associated refrigerator appliance.

Accordingly, a linear compressor with features for limiting friction and/or contact between a piston and a wall of a cylinder during operation of the linear compressor would be useful.

BRIEF DESCRIPTION OF THE INVENTION

The present subject matter provides a linear compressor and a method for lubricating a piston in the same. The linear compressor includes a sleeve that defines a groove, a plurality of channels and a plurality of thru-holes. A piston is slidably received within a chamber of the sleeve. The piston defines a plurality of pockets. The groove of the sleeve, the plurality of channels of the sleeve, the plurality of thru-holes of the sleeve, and the plurality of pockets of the piston are configured for directing liquid oil therethrough during operation of the linear compressor. Additional aspects and advantages of the invention will be set forth in part in the following description, or may be apparent from the description, or may be learned through practice of the invention.

In a first exemplary embodiment, a linear compressor is provided. The linear compressor defines an axial direction, a radial direction and a circumferential direction. The linear compressor includes a cylinder assembly having a sleeve. The sleeve has an inner surface and an outer surface spaced apart from each other along the radial direction. The outer surface of the sleeve defines a groove extending about the sleeve along the circumferential direction. The outer surface of the sleeve also defines a plurality of channels extending from the groove of the sleeve along the axial direction. The sleeve also defines a plurality of thru-holes. Each thru-hole of the plurality of thru-holes positioned at a distal end of a respective one of the plurality of channels. Each thru-hole of the plurality of thru-holes extends through the sleeve to the inner surface of the sleeve. The inner surface of the sleeve defines a chamber. A piston is slidably received within the chamber of the sleeve. The piston has an outer surface that is positioned adjacent and faces the inner surface of the sleeve. The outer surface of the piston defines a plurality of pockets. Each pocket of the plurality of pockets is aligned with a respective one of the plurality of thru-holes of the sleeve. A driving coil is operable to move the piston within the chamber of the sleeve. The groove of the sleeve, the plurality of channels of the sleeve, the plurality of thru-holes of the sleeve, and the plurality of pockets of the piston are sized for directing liquid oil therethrough during operation of the linear compressor.

In a second exemplary embodiment, a method for lubricating a piston of a linear compressor is provided. The method comprises supplying liquid oil into a groove of a sleeve of the linear compressor, distributing liquid oil from the groove of the sleeve into a plurality of channels of the sleeve, directing liquid oil in each channel of the plurality of channels into respect thru-holes of a plurality of thru-holes of the sleeve, and receiving liquid oil from each thru-hole of the thru-holes in a respective pocket of a plurality of pockets of the piston.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
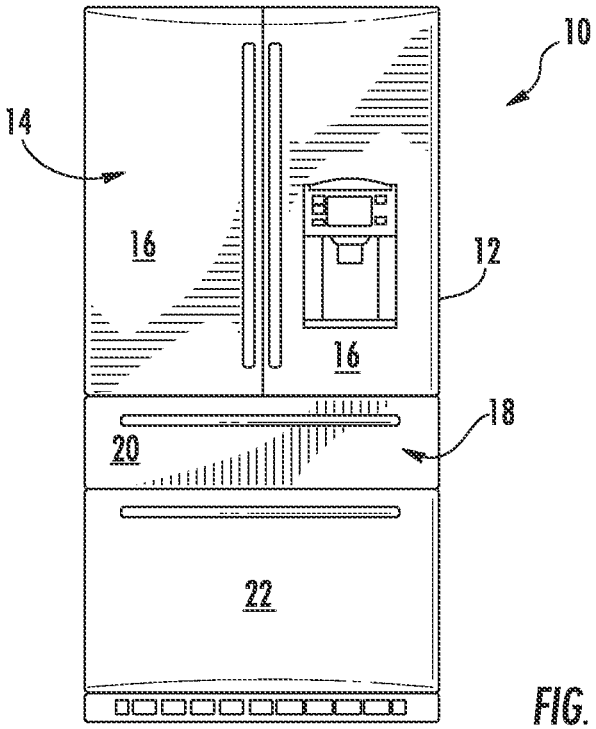
FIG. 1 is a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
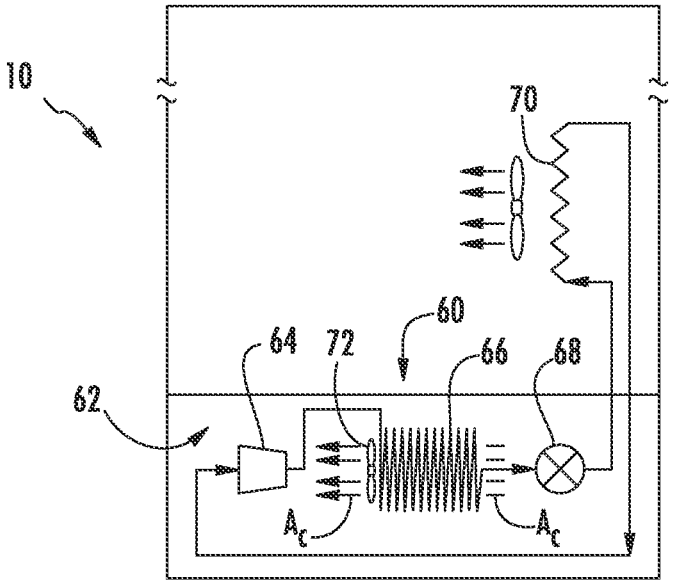
FIG. 2 is schematic view of certain components of the exemplary refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated exemplary embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Figure 3:
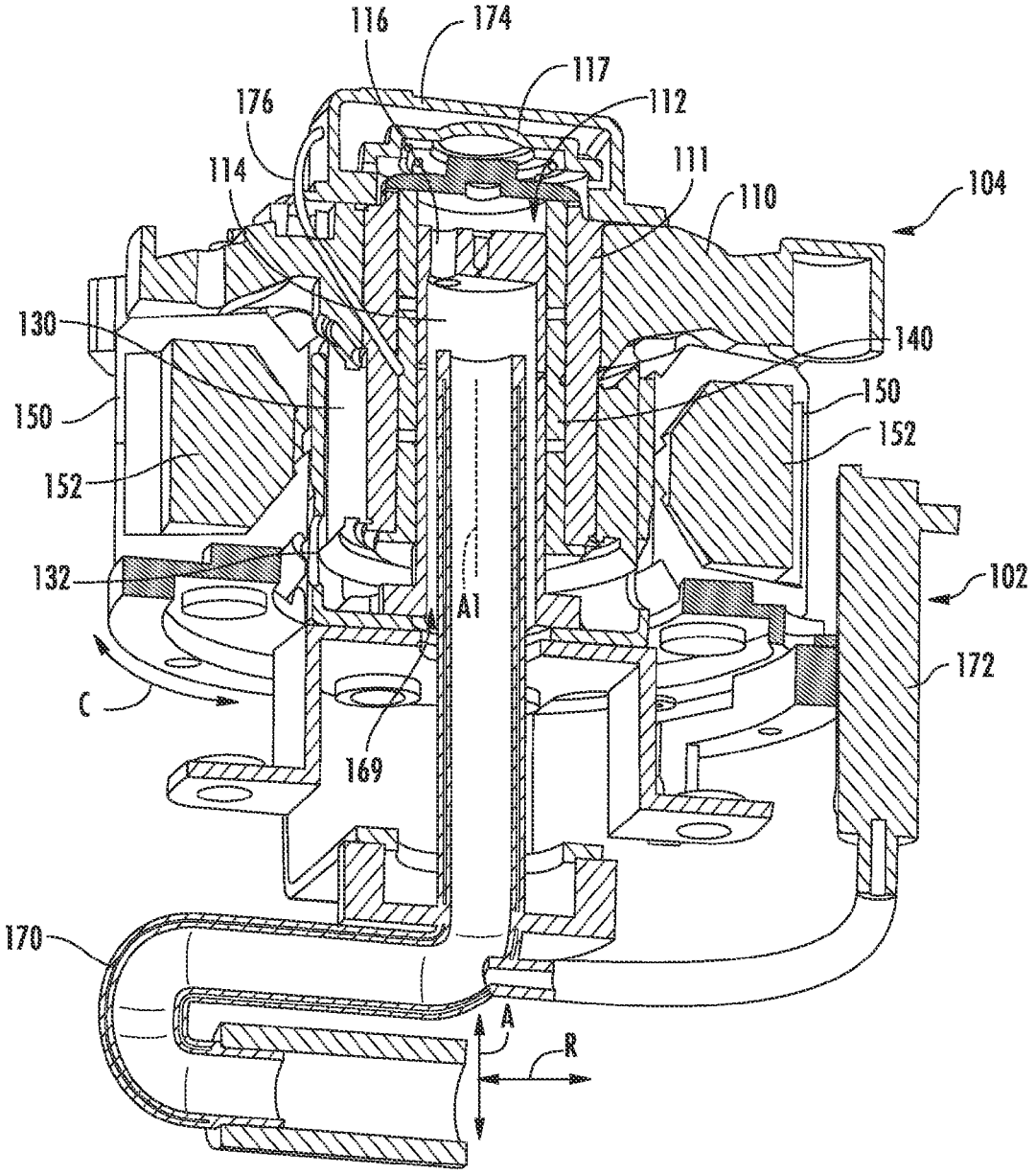
FIG. 3 provides a perspective section view of a linear compressor according to an exemplary embodiment of the present subject matter.
Figure 4:
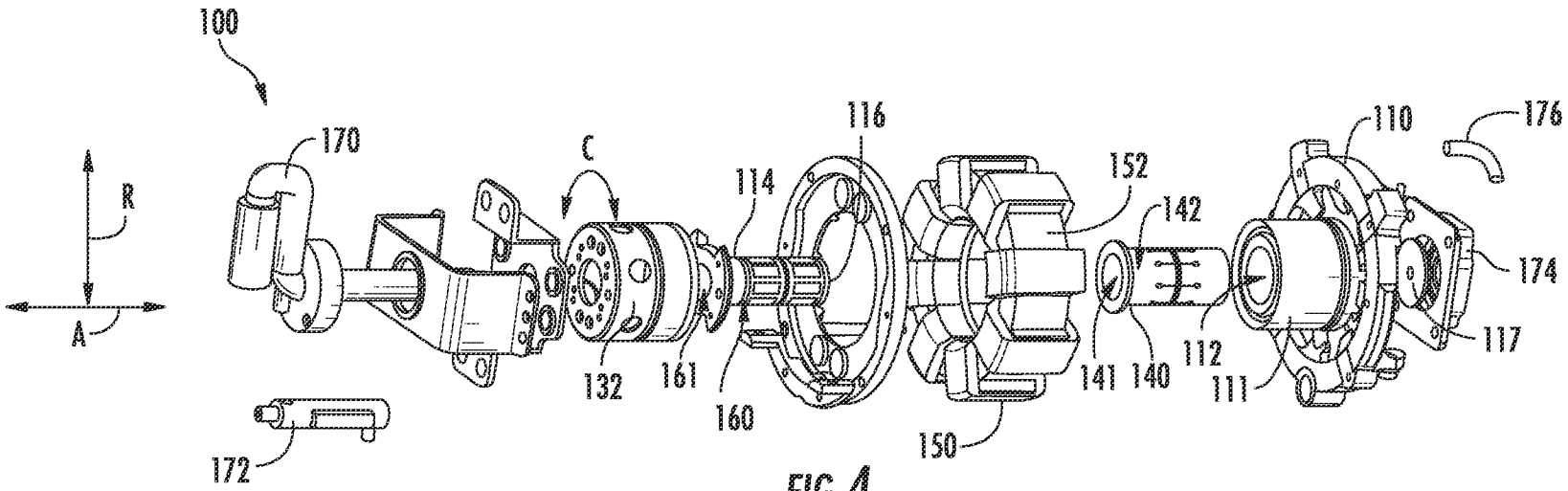
FIG. 4 provides an exploded view of the exemplary linear compressor of FIG. 3.
Figure 5:
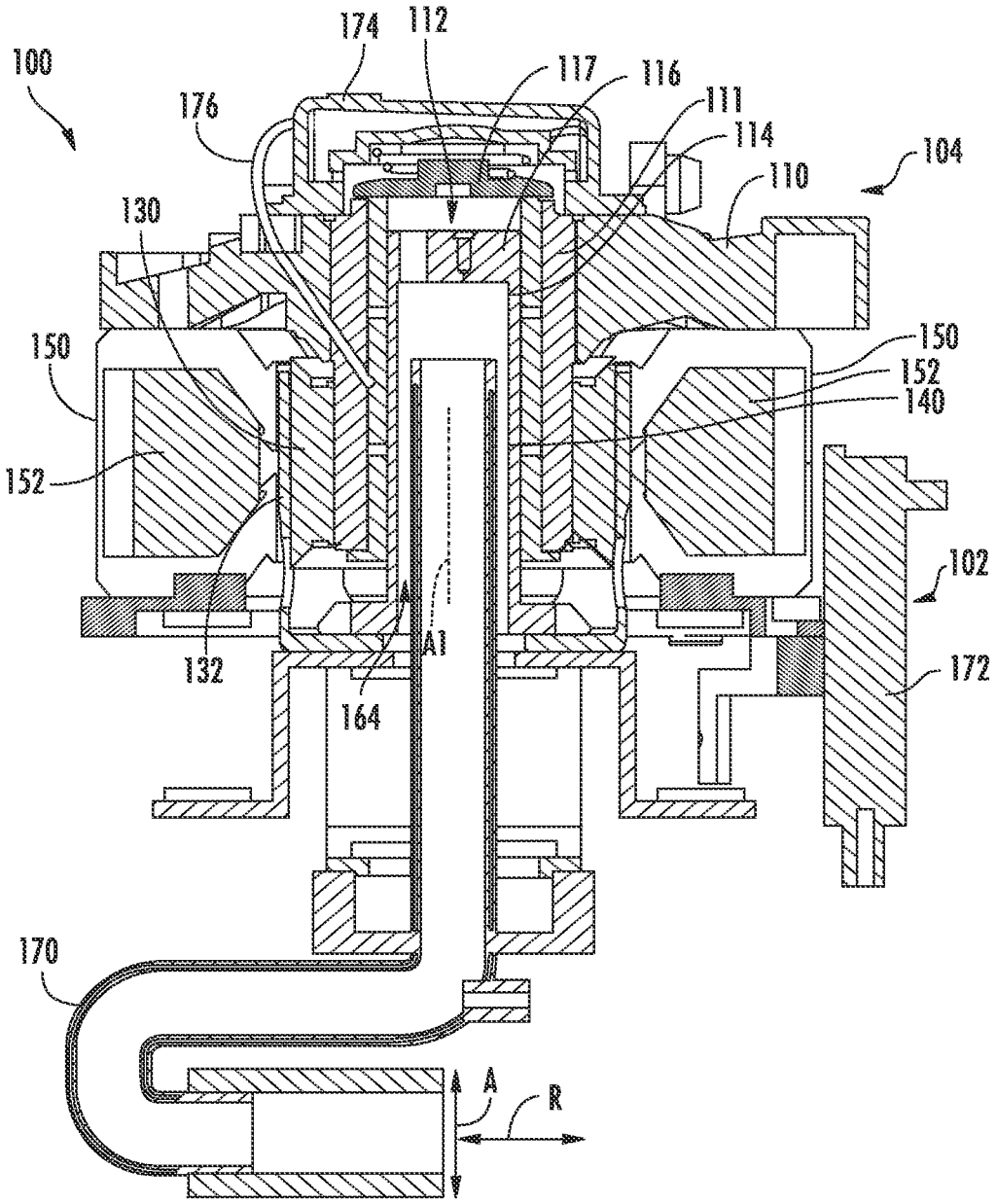
FIG. 5 provides a side section view of the exemplary linear compressor of FIG. 3.

FIG. 3 provides a perspective section view of a linear compressor 100 according to an exemplary embodiment of the present subject matter. FIG. 4 provides an explode view of linear compressor 100. FIG. 5 provides a side section view of linear compressor 100. As discussed in greater detail below, linear compressor 100 is operable to increase a pressure of fluid within a chamber 112 of linear compressor 100. Linear compressor 100 may be used to compress any suitable fluid, such as refrigerant or air. In particular, linear compressor 100 may be used in a refrigerator appliance, such as refrigerator appliance 10 (FIG. 1) in which linear compressor 100 may be used as compressor 64 (FIG. 2). As may be seen in FIG. 3, linear compressor 100 defines an axial direction A, a radial direction R and a circumferential direction C. Linear compressor 100 may be enclosed within a hermetic or air-tight shell (not shown). The hermetic shell can, e.g., hinder or prevent refrigerant from leaking or escaping from refrigeration system 60.

Linear compressor 100 includes a casing 110 that extends between a first end portion 102 and a second end portion 104, e.g., along the axial direction A. Casing 110 includes various static or non-moving structural components of linear compressor 100. In particular, casing 110 includes a cylinder assembly 111 that defines a chamber 112. Cylinder assembly 111 is positioned at or adjacent second end portion 104 of casing 110. Chamber 112 extends longitudinally along the axial direction A. A stator of a motor of linear compressor 100 is mounted or secured to casing 110. The stator of the motor includes an outer back iron 150 and a driving coil 152. Linear compressor 100 also includes valves (such as a discharge valve 117 at an end of chamber 112) that permit refrigerant to enter and exit chamber 112 during operation of linear compressor 100.

A piston assembly 114 with a piston head 116 is slidably received within chamber 112 of cylinder assembly 111. In particular, piston assembly 114 is slidable along a first axis A1 within chamber 112. The first axis A1 may be substantially parallel to the axial direction A. During sliding of piston head 116 within chamber 112, piston head 116 compresses refrigerant within chamber 112. As an example, from a top dead center position, piston head 116 can slide within chamber 112 towards a bottom dead center position along the axial direction A, i.e., an expansion stroke of piston head 116. When piston head 116 reaches the bottom dead center position, piston head 116 changes directions and slides in chamber 112 back towards the top dead center position, i.e., a compression stroke of piston head 116. It should be understood that linear compressor 100 may include an additional piston head and/or additional chamber at an opposite end of linear compressor 100. Thus, linear compressor 100 may have multiple piston heads in alternative exemplary embodiments.

Linear compressor 100 also includes an inner back iron 130 and a magnetic cup or cylinder 132. Inner back iron 130 and magnetic cylinder 132 are positioned in the stator of the motor. In particular, outer back iron 150 and/or driving coil 152 may extend about inner back iron 130 and magnetic cylinder 132, e.g., along the circumferential direction C.

Magnetic cylinder 132 is positioned between driving coil 152 (e.g., and outer back iron 150) and inner back iron 130, e.g., along the radial direction R. Magnetic cylinder 132 may face and/or be exposed to driving coil 152. In particular, magnetic cylinder 132 may be spaced apart from outer back iron 150 and driving coil 152, e.g., along the radial direction R by an air gap. Thus, the air gap may be defined between opposing surfaces of magnetic cylinder 132 and driving coil 152. Magnetic cylinder 132 may also be spaced apart from inner back iron 130, e.g., along the radial direction R, by an additional air gap.

As may be seen in FIG. 4, driving coil 152 extends about back iron assembly 130 and magnetic cylinder 132, e.g., along the circumferential direction C. Driving coil 152 is operable to move magnetic cylinder 132 along the axial direction A during operation of driving coil 152. As an example, driving coil 152 may receive a current from a current source (not shown) in order to generate a magnetic field that engages magnetic cylinder 132 to move magnetic cylinder 132. In addition, piston assembly 114 is mounted or coupled to magnetic cylinder 132, e.g., via mounting plate 168 (FIG. 8) of piston assembly 114, such that operation of driving coil 152 also urges piston assembly 114 to move along the axial direction A in order to compress refrigerant within chamber 112 as described above and will be understood by those skilled in the art. In particular, the magnetic field of driving coil 152 may engage magnetic cylinder 132 in order to move piston head 116 along the first axis A1 during operation of driving coil 152. Thus, driving coil 152 may slide piston assembly 114 between the top dead center position and the bottom dead center position, e.g., by moving magnetic cylinder 132.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 152. Thus, the controller may selectively activate driving coil 152, e.g., by supplying current to driving coil 152, in order to compress refrigerant with piston assembly 114 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Linear compressor 100 uses liquid oil to reduce friction between piston assembly 114 and cylinder assembly 111 and/or lubricate piston assembly 114. Liquid oil supplied to cylinder assembly 111 may also assist with centering piston assembly 114 within chamber 112, as discussed in greater detail below. Thus, linear compressor 100 includes features for supplying liquid oil to piston assembly 114, e.g., in order to reduce friction between piston assembly 114 and cylinder assembly 111 and/or center piston assembly 114 within chamber 112.

As may be seen in FIG. 3, linear compressor 100 includes a suction inlet tube 170 and a sump pump 172. Suction inlet tube 170 is configured for directing a flow of compressible fluid to a passage 169 of piston assembly 114. Thus, fluid to be compressed with piston assembly 114 is directed into linear compressor 100 via suction inlet tube 170. In particular, suction inlet tube 170 is positioned for directing fluid into passage 169 of piston assembly 114. Sump pump 172 is configured for directing liquid oil into the flow of compressible fluid in suction inlet tube 170. In particular, sump pump 172 is operable to direct liquid oil into suction inlet tube 170 such that the liquid oil is carried into passage 169 of piston assembly 114 and chamber 112 of cylinder assembly 111 via the flow of fluid through suction inlet tube 170.

Linear compressor 100 also includes a separator 174 (shown schematically). Separator 174 is positioned downstream of discharge valve 117, e.g., adjacent second end portion 104 of casing 110. Separator 174 is configured for collecting liquid oil therein. Thus, liquid oil within compressed fluid exiting discharge valve 117 is collected within separator 174. Separator 174 may be any suitable mechanism for collecting liquid oil from compressed fluid exiting discharge valve 117. For example, separator 174 may include glass fibers sized for collecting liquid oil thereon. A conduit 176 extends from separator 174 to cylinder assembly 111. Conduit 176 is configured for directing liquid oil from separator 174 to cylinder assembly 111 in order to lubricate movement of piston assembly 114 within cylinder assembly 111 as discussed in greater detail below.

Figure 6:
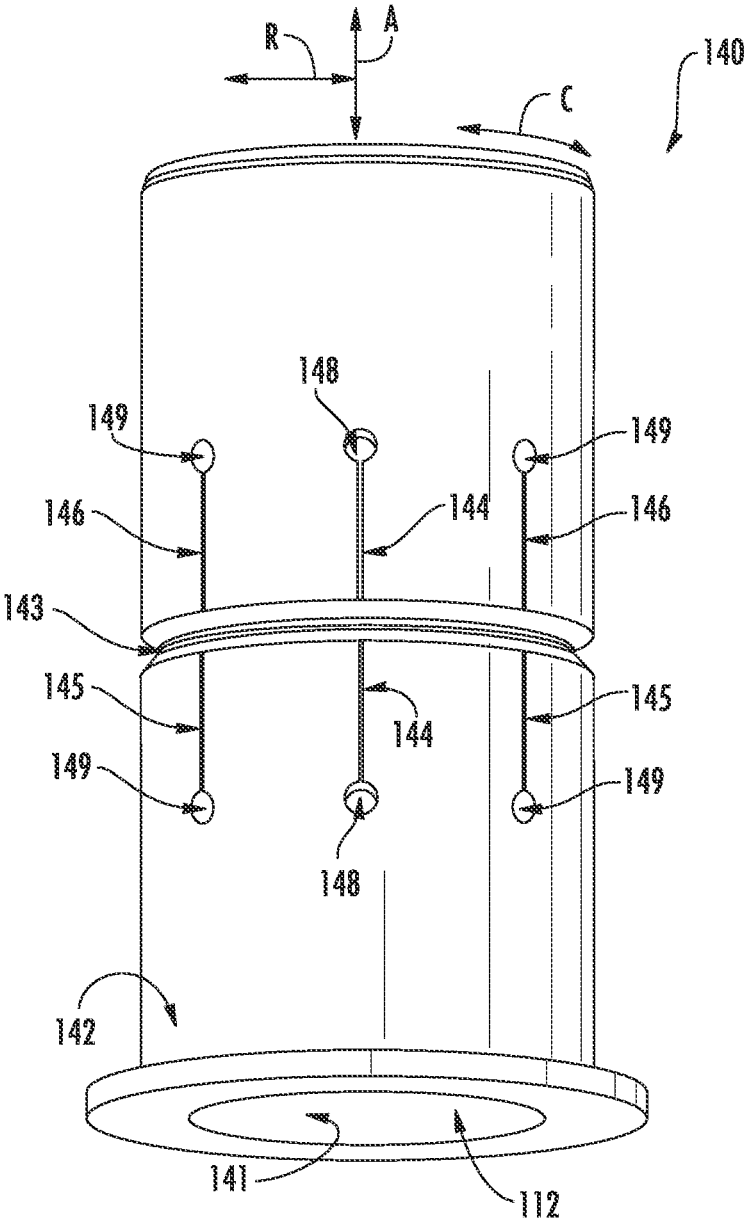
FIG. 6 provides a perspective view of a sleeve of the exemplary linear compressor of FIG. 3.
Figure 7:
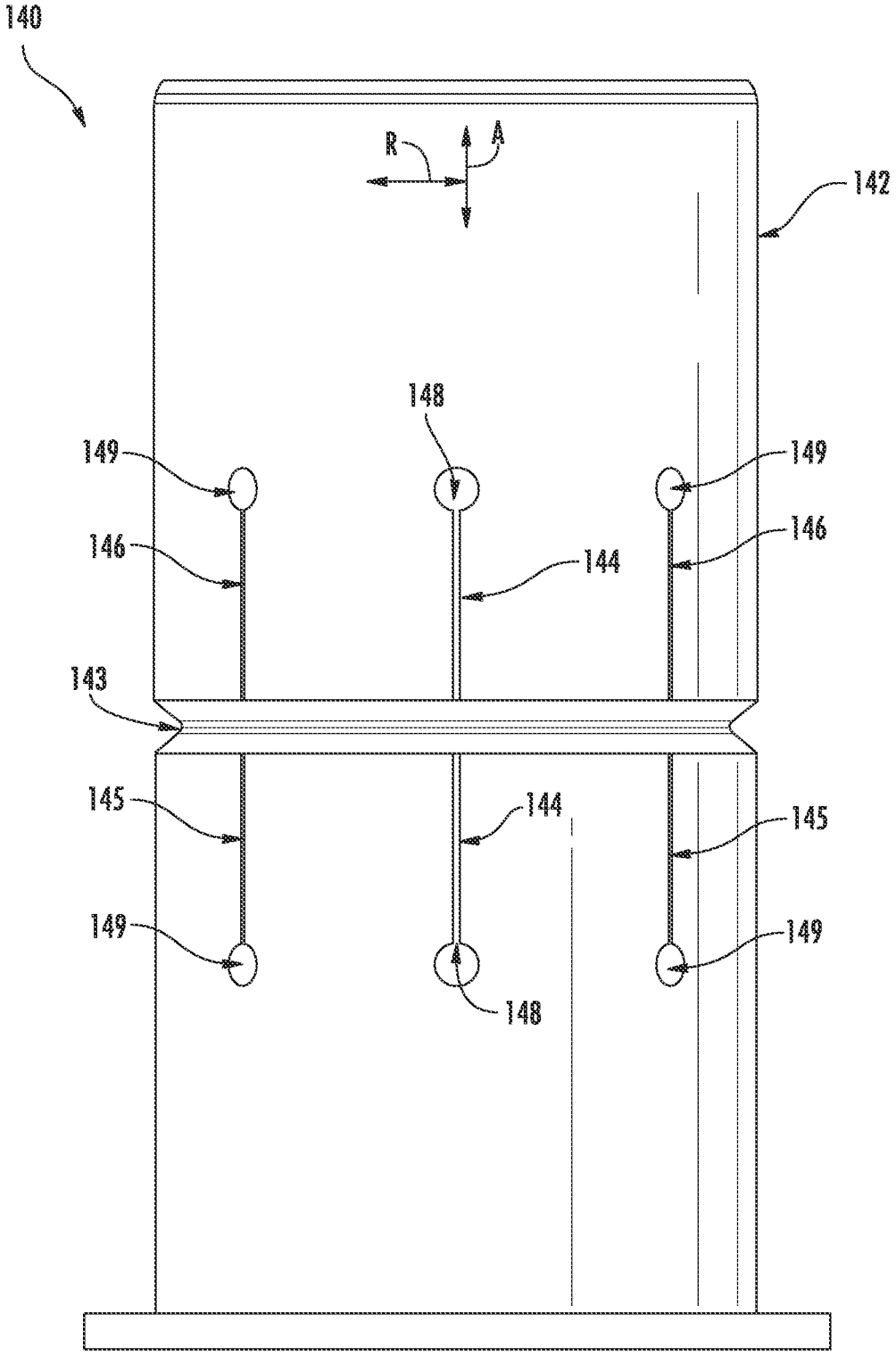
FIG. 7 provides a side elevation view of the sleeve of FIG. 6.

FIG. 6 provides a perspective view of a sleeve 140 of cylinder assembly 111. FIG. 7 provides a side elevation view of sleeve 140. Sleeve has an inner surface 141 and an outer surface 142. Inner and outer surfaces 141 and 142 of sleeve 140 are positioned opposite each other on sleeve 140. Thus, inner and outer surfaces 141 and 142 of sleeve 140 are spaced apart from each other, e.g., along the radial direction R. Inner surface 141 of sleeve 140 defines chamber 112 of cylinder assembly 111.

As may be seen in FIGS. 6 and 7, sleeve 140 defines a groove 143 at outer surface 142 of sleeve 140. Groove 143 of sleeve 140 extends about sleeve 140, e.g., along the circumferential direction C. Sleeve 140 also defines a plurality of channels 144 at outer surface 142 of sleeve 140. Channels 144 are distributed along the circumferential direction C on outer surface 142 of sleeve 140.

Channels 144 extend from groove 143 of sleeve 140, e.g., along the axial direction A. In particular, channels 144 include a first plurality of channels 145 and a second plurality of channels 146. First and second pluralities of channels 145 and 146 are positioned at or on opposite sides of groove 143 of sleeve 140. In particular, first plurality of channels 145 is positioned on or at a first side of groove 143 of sleeve 140, and second plurality of channels 146 is positioned on or at a second side of groove 143 of sleeve 140. First and second pluralities of channels 145 and 146 may include any suitable number of channels. For example, first and second pluralities of channels 145 and 146 may each include two, three, four, five, ten, twenty or more channels. In certain exemplary embodiments, first and second pluralities of channels 145 and 146 each include at least eight channels.

Sleeve 140 also defines a plurality of thru-holes 149. Each thru-hole of thru-holes 149 is positioned at a distal end 148 of a respective one of channels 144. Thus, channels 144 extend between groove 143 of sleeve 140 and thru-holes 149, e.g., along the axial direction A. Thru-holes 149 also extending through sleeve 140, e.g., from outer surface 142 of sleeve 140 to inner surface 141 of sleeve 140.

Figure 8:
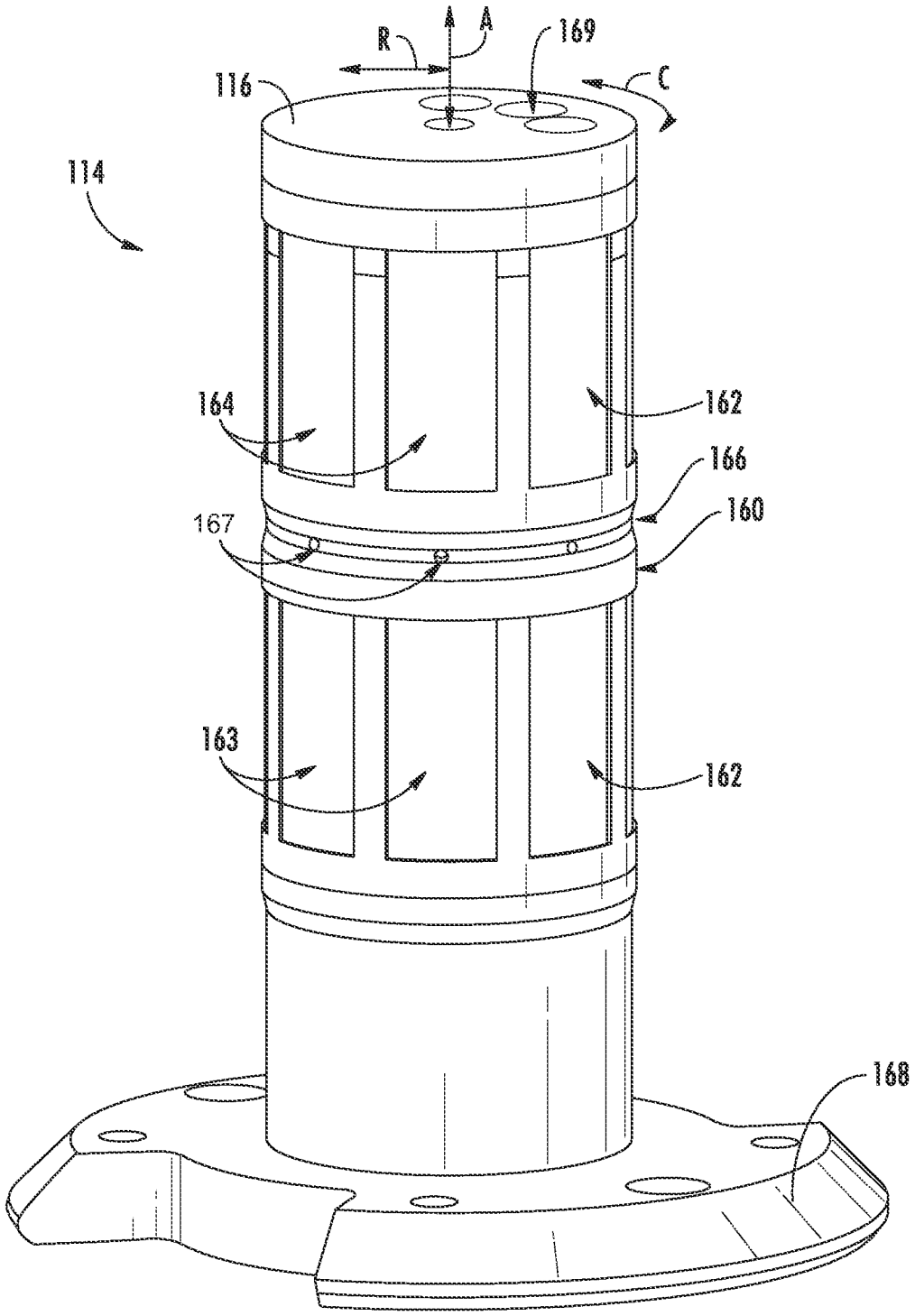
FIG. 8 provides a perspective view of a piston of the exemplary linear compressor of FIG. 3.
Figure 9:
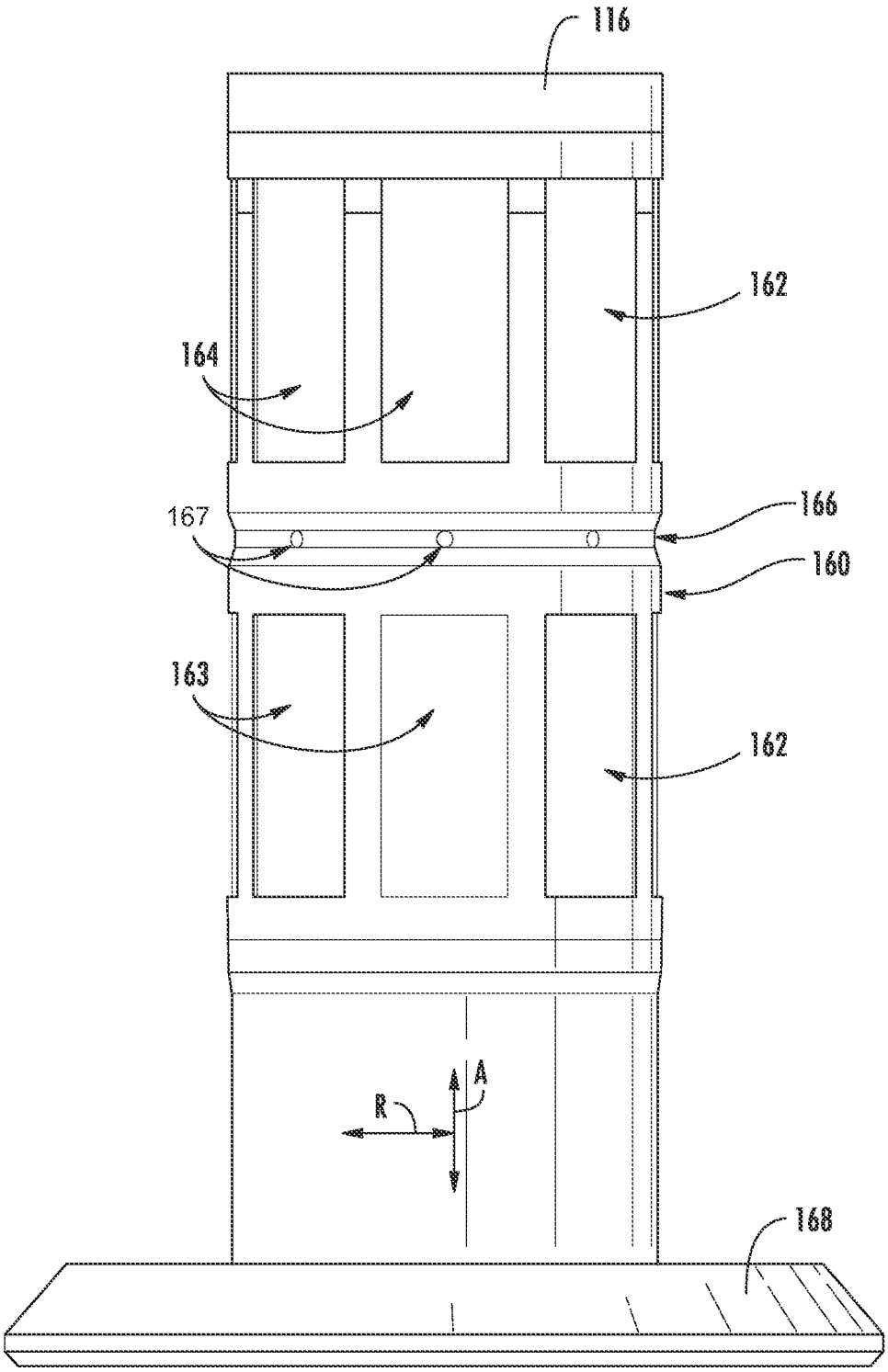
FIG. 9 provides a side elevation view of the piston of FIG. 8.

FIG. 8 provides a perspective view of piston assembly 114. FIG. 9 provides a side elevation view of piston assembly 114. Piston assembly 114 is slidably received within chamber 112 of sleeve 140. Piston has an outer surface 160 and an inner surface 161 (FIG. 4). Inner surface 161 of piston assembly 114 defines passage 169 of piston assembly 114. As discussed above, passage 169 of piston assembly 114 directs fluid into chamber 112 of sleeve 140 for compression therein. Outer surface 160 of piston assembly 114 is positioned adjacent and faces inner surface 141 of sleeve 140. Piston assembly 114 also defines a plurality of pockets 162 at outer surface 160 of piston assembly 114. Each pocket of pockets 162 is aligned with a respective one of thru-holes 149 of sleeve 140, e.g., along the radial direction R. Pockets 162 extend into piston assembly 114, e.g., along the radial direction R.

Pockets 162 include a first plurality of pockets 163 and a second plurality of pockets 164. Piston assembly 114 also defines a groove 166, e.g., at outer surface 160 of piston assembly 114. Groove 166 of piston assembly 114 extends about piston assembly 114, e.g., along the circumferential direction C, and is positioned between first and second pluralities of pockets 163 and 164, e.g., along the axial direction A. Piston assembly 114 further defies a plurality of feedback holes 167. Feedback holes 167 extend from groove 166 of piston assembly 114 to passage 169 of piston assembly 114, e.g., along the radial direction R.

As discussed above, motion of piston assembly 114 within sleeve 140 is lubricated with liquid oil, e.g., to reduce friction between sleeve 140 and piston assembly 114 and/or to assist with centering piston assembly 114 within chamber 112 of sleeve 140. As discussed in greater detail below, groove 143 of sleeve 140, channels 144 of sleeve 140, thru-holes 149 of sleeve 140, pockets 162 of piston assembly 114 are sized for directing liquid oil therethrough, e.g., during operation of linear compressor 100. Liquid oil flowing through such features of linear compressor 100 can assist with reducing friction between sleeve 140 and piston assembly 114 and/or with centering piston assembly 114 within chamber 112 of sleeve 140

As an example of operation of linear compressor 100, liquid oil from separator 174 may be supplied or directed to groove 143 of sleeve 140. For example, liquid oil may be directed via conduit 176 from separator 174 to groove 143 of sleeve 140. The liquid oil supplied to groove 143 of sleeve 140 may have any suitable pressure. For example, the pressure of liquid oil supplied to groove 143 of sleeve 140 may be about equal to a pressure of fluid discharging from chamber 112 of cylinder assembly 111 at discharge valve 117. In certain exemplary embodiments, the pressure of liquid oil supplied to groove 143 of sleeve 140 may be about sixty-five pounds per square inch.

From groove 143 of sleeve 140, liquid oil flows into channels 144. Within channels 144, the pressure of liquid oil may drop by at least fifty percent. Thus, channels 144 may be sized for reducing the pressure of liquid oil flowing therethrough by at least fifty percent. From channels 144, liquid oil is directed into thru-holes 149. At thru-holes 149, liquid oil flows through sleeve 140 into pockets 162 of piston assembly 114. Thus, liquid oil may be directed to pockets 162 from separator 174 via the components of linear compressor 100 described above.

Within pockets 162, liquid oil reduces friction between sleeve 140 and piston assembly 114 and/or assists with centering piston assembly 114 within chamber 112 of sleeve 140. In particular, when piston assembly 114 is misaligned within chamber 112, a flow rate of liquid oil to a first portion of pockets 162 decreases, e.g., due to a pressure increase of liquid oil within the first portion of pockets 162, and a flow rate of liquid oil to a second portion of pockets 162 increases, e.g., due to a pressure decrease of liquid oil within the second portion of pockets 162. The decreased flow of liquid oil to the first portion of pockets 162 and the increased flow of liquid oil to the second portion of pockets 162 may urge piston assembly 114 towards a center of chamber 112. In such a manner, liquid oil can assist with centering piston assembly 114 within chamber 112 of sleeve 140. From pockets 163, liquid oil may flow into groove 166 of piston assembly 114 and feedback holes 167 in order to permit the liquid oil to flow to separator 174 and be recirculated or recycled through linear compressor 100.

While described in the context of linear compressor 100, it should be understood that the present subject matter may be used in any suitable linear compressor. For example, the present subject matter may be used in linear compressors with moving or dynamic inner back irons. As another example, the features of sleeve 140, such as groove 143, channels 144 and thru-holes 149, and piston assembly 114, such as pockets 162, may be used in any suitable linear compressor, e.g., to reduce friction on a piston assembly and/or assists with centering the piston assembly within a chamber.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A linear compressor defining an axial direction, a radial direction and a circumferential direction, the liner compressor comprising:

a cylinder assembly having a sleeve, the sleeve having an inner surface and an outer surface spaced apart from each other along the radial direction, the outer surface of the sleeve defining a groove extending about the sleeve along the circumferential direction, the outer surface of the sleeve also defining a plurality of channels extending from the groove of the sleeve along the axial direction, the sleeve also defining a plurality of thru-holes, each thru-hole of the plurality of thru-holes positioned at a distal end of a respective one of the plurality of channels, each thru-hole of the plurality of thru-holes extending through the sleeve to the inner surface of the sleeve, the inner surface of the sleeve defining a chamber;

a piston slidably received within the chamber of the sleeve, the piston having an outer surface that is positioned adjacent and faces the inner surface of the sleeve, the outer surface of the piston defining a plurality of pockets, each pocket of the plurality of pockets aligned with a respective one of the plurality of thru-holes of the sleeve; and a driving coil operable to move the piston within the chamber of the sleeve, wherein the groove of the sleeve, the plurality of channels of the sleeve, the plurality of thru-holes of the sleeve, and the plurality of pockets of the piston are sized for directing liquid oil therethrough during operation of the linear compressor.

2. The linear compressor of claim 1, wherein the plurality of channels comprises a first plurality of channels and a second plurality of channels, the first and second pluralities of channels positioned at opposite sides of the groove.

3. The linear compressor of claim 2, wherein the first and second pluralities of channels each comprise at least eight channels.

4. The linear compressor of claim 1, wherein the plurality of pockets comprises a first plurality of pockets and a second plurality of pockets, the outer surface of the piston defining a groove, the groove positioned between the first and second pluralities of pockets along the axial direction.

5. The linear compressor of claim 1, wherein the outer surface of the piston defines a groove that extends about the piston along the circumferential direction, the piston also having an inner surface positioned opposite the outer surface of the piston, the inner surface of the piston defining a passage that extends through the piston along the axial direction, the piston defining a plurality of feedback holes that extend from the groove of the piston to the passage of the piston along the radial direction.

6. The linear compressor of claim 1, wherein the plurality of channels of the sleeve is sized for reducing a pressure of liquid oil flowing therethrough by at least fifty percent.

7. The linear compressor of claim 1, further comprising a suction inlet tube and a sump pump, the piston having an inner surface positioned opposite the outer surface of the piston, the inner surface of the piston defining a passage that extends through the piston along the axial direction, the suction inlet tube positioned for directing a flow of fluid into the passage of the piston, the sump pump configured for directing liquid oil into the flow of fluid in the suction inlet tube.

8. The linear compressor of claim 1, further comprising a discharge valve and a separator, the discharge valve positioned at the chamber of the sleeve, the separator disposed downstream of the discharge valve, the separator configured for collecting liquid oil therein.

9. The linear compressor of claim 8, further comprising a conduit extending from the separator to the sleeve, the conduit configured for directing liquid oil from the separator to the groove of the sleeve.

10. The linear compressor of claim 1, further comprising a magnetic cylinder, the driving coil extending about the magnetic cylinder along the circumferential direction, a magnetic field of the driving coil engaging the magnetic cylinder in order to move the magnetic cylinder along the axial direction during operation of the driving coil, the piston being coupled to the magnetic cylinder.

11. The linear compressor of claim 1, wherein the plurality of channels are distributed along the circumferential direction on the outer surface of the sleeve.

12. The linear compressor of claim 1, wherein the plurality of channels extend between the groove of the sleeve and the plurality of thru-holes along the axial direction.

13. The linear compressor of claim 1, wherein the pockets of the plurality of pockets extend into the piston along the radial direction.

14. A method for lubricating a piston of a linear compressor, comprising supplying a liquid oil into a groove of a sleeve of the linear compressor;

distributing the liquid oil from the groove of the sleeve into a plurality of channels of the sleeve;

directing the liquid oil in each channel of the plurality of channels into respective thru-holes of a plurality of thru-holes of the sleeve; and receiving the liquid oil from each thru-hole of the thru-holes in a respective pocket of a plurality of pockets of the piston.

15. The method of claim 14, wherein a pressure of the liquid oil in the plurality of channels drops by at least fifty percent during said step of distributing.

16. The method of claim 15, wherein a pressure of the liquid oil in the groove is about sixty-five pounds per square inch at said step of supplying.

17. The method of claim 14, wherein said step of supplying comprises supplying the liquid oil from a separator of the linear compressor into the groove of the sleeve, the separator positioned downstream of a discharge valve of the linear compressor.

18. The method of claim 14, further comprising increasing a flow rate of the liquid oil to a first plurality of pockets of the plurality of pockets and decreasing a flow rate of the liquid oil to a second plurality of pockets of the plurality of pockets, the first plurality of pockets positioned closer to the sleeve than the second plurality of pockets.

* * * * *